United States Patent [19]

Hsu

[11] Patent Number: 4,951,730

[45] Date of Patent: Aug. 28, 1990

[54] WINDOW BLIND SYSTEM

[76] Inventor: Chi-Hsueh Hsu, 4F, No. 144, Chu Lin Road, Yung Ho, Taipei, Taiwan

[21] Appl. No.: 385,088

[22] Filed: Jul. 26, 1989

[51] Int. Cl.[5] ..... E06B 9/20

[52] U.S. Cl. ..... 160/310; 160/23.1; 160/5

[58] Field of Search ..... 160/310, 323.1, 324, 160/5, 23.1, 26, 188

[56] References Cited

U.S. PATENT DOCUMENTS 3,854,517 12/1974 Nakamura ..... 160/323.1

4,664,169 5/1987 Osaka et al. ..... 160/107

4,726,409 2/1988 Besler ..... 160/26 X

*Primary Examiner*—Blair M. Johnson

*Attorney, Agent, or Firm*—Morton J. Rosenberg; David I. Klein

[57] ABSTRACT

A window blind system for a window comprising a longitudinal casing which is arranged to be transversely fixed to a window frame above a window to be shaded, a roller blind mechanism carrying an opaque blind and mounted to the casing in a position under the casing and a driving assembly and a control circuit and a control unit for operating the roller mechanism unit to roll out or rewind the blind.

1 Claim, 5 Drawing Sheets

WINDOW BLIND SYSTEM

BACKGROUND OF THE INVENTION

The present invention relates to a window blind system, and more particularly to a window blind system to be operated by electric power combining solar-electric power system, rechargeable battery power system and power source of home application.

Conventionally, window blind systems for adjustably shading sunlight are manually operated. Said window blind systems may be operated from time to time within a day according to different time and different stage of work or daily living. Although it is an easy task in manually operating the window blind systems, still inconvenient in doing so and may cause the systems out of order as too heavy of strength in operations.

SUMMARY OF THE INVENTION

To this end, it is an object of the present invention to provide an improved window blind system which is simple in construction and installation and easy to operate.

In accordance with the present invention, there is provided with a window blind system for a window comprising a longitudinal casing which is arranged to be transversely fixed to a window frame above a window to be shaded, a roller blind mechanism carrying an opaque blind and mounted to the casing in a position under the casing and a driving assembly and a control circuit and a control unit for operating the roller mechanism unit to roll out or rewind the blind.

BRIEF DESCRIPTION OF THE DRAWINGS

The present invention is described further hereinafter, by way of example only, with reference to the accompanying drawings, in which.

DETAILED DESCRIPTION OF THE PREFERRED EMBODIMENT

Figure 1:
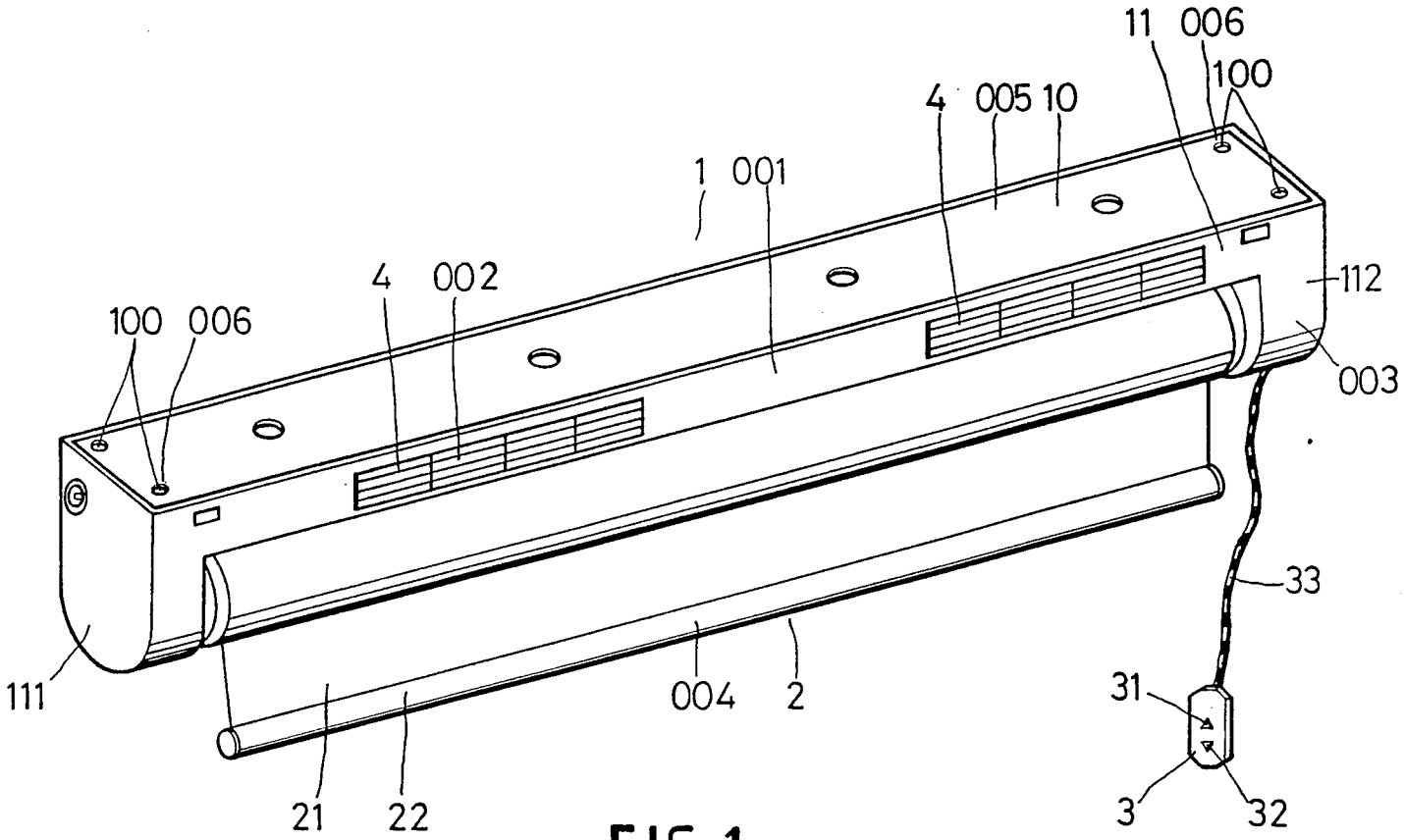
FIG. 1 is a perspective view showing one embodiment of a window blind system in accordance with this invention.

Referring now to FIG. 1, a window blind system 1 according to the present invention includes a longitudinal casing 11 having an open upper end and terminating with opposite right-angled end portions 111, 112 extending downwardly, a cover plate 10 adapted for closing the opening of the casing 11 and further secured thereto by proper means such as screws (not shown) to be threaded through screw holes 100 formed in opposite end portions and having four or more screw holes in larger dimension for mounting the blind system 1 onto a frame above the window to be shaded, solar mirrors 4 transversely engaged in side walls of the casing 11 and exposing to the sunlight, a roller blind mechanism 2 installed between the righ-angled end portions 111, 112 and under the longitudinal portion of the casing 11 and a remote controller 3 connected with the casing 11 through a control wire 33 and having a upward control button 31 and a downward control button 32.

The roller blind mechanism 2 carries a blind 21 of opaque cloth or nylon film and a leading bar 22 is attached to the leading transverse edge of the blind 21.

Figure 2:
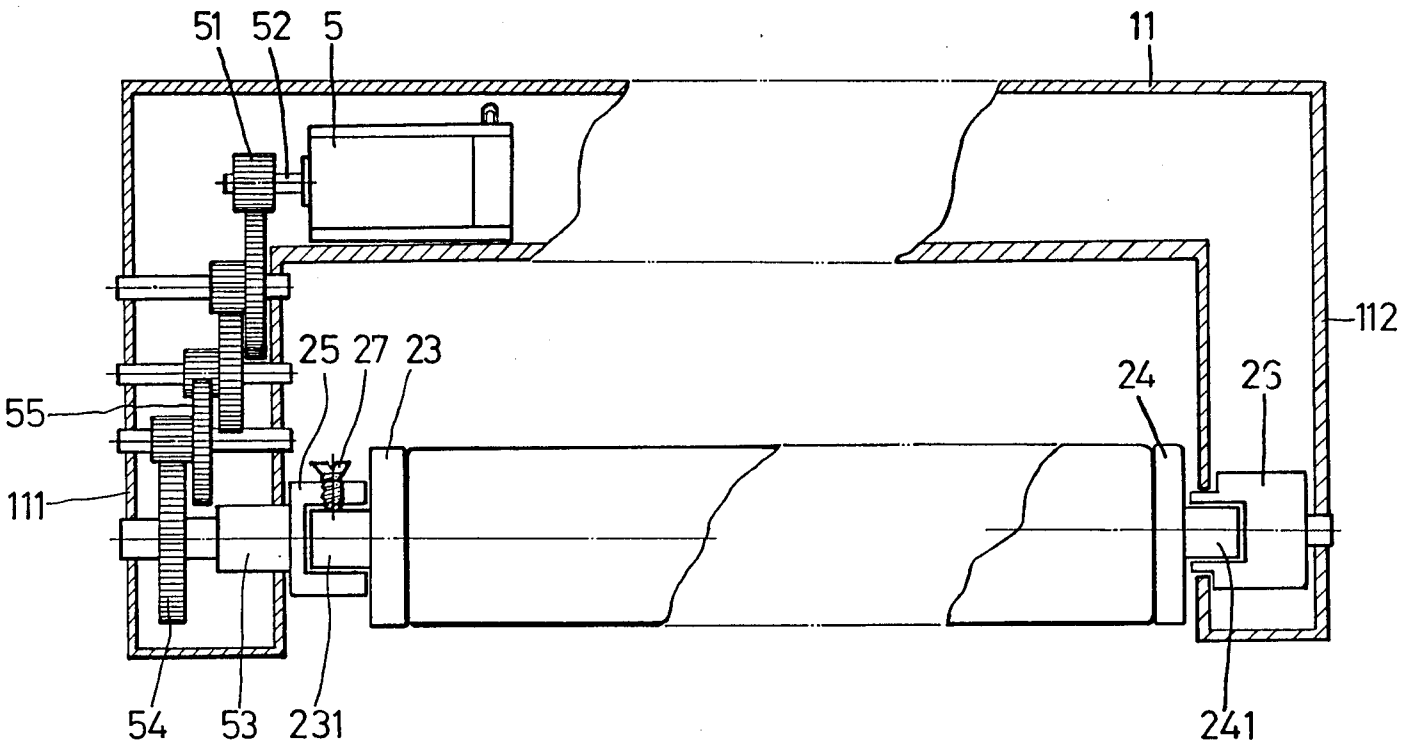
FIG. 2 is a front elevational view of the present invention.

Referring to FIG. 2, the roller blind mechanism 2 comprises a cylindrical roller with two end portions thereof fitted with two circular discs 23, 24 for retaining the wound blind 21 inbetween. Each of the two circular discs 23, 24 has a central cylindrical spigot 231 or 241 received in a rotating support 25, 26. The roller mechanism 2 is thus journaled between the two right-angles end portions 111, 112 of the casing 11 but with the roller non-rotatable relative to the rotating support 25, 26 by means of, at least, a screw 27 interengaging the rotating support 25 and the spigot 231.

A shaft 53 is rotatably and transversely mounted in the end portion 111 with one end portion firmly fitting a gear 54 and the other end being fixed to the rotating support 25. The other rotating support 26 is rotatably mounted in the opposed end portion 112.

A reversible electric motor 5 is mounted in the longitudinal portion of the casing 11 and adjacent to the right-angled end portion 111 with a gear 51 mounted on a shaft 52 thereof. A reduction gear assembly 55 is provided to interengage the gears 51 and 54 so as to reduce rotation speed and enhance torsion of the roller of the roller blind mechanism 2.

Figure 3:
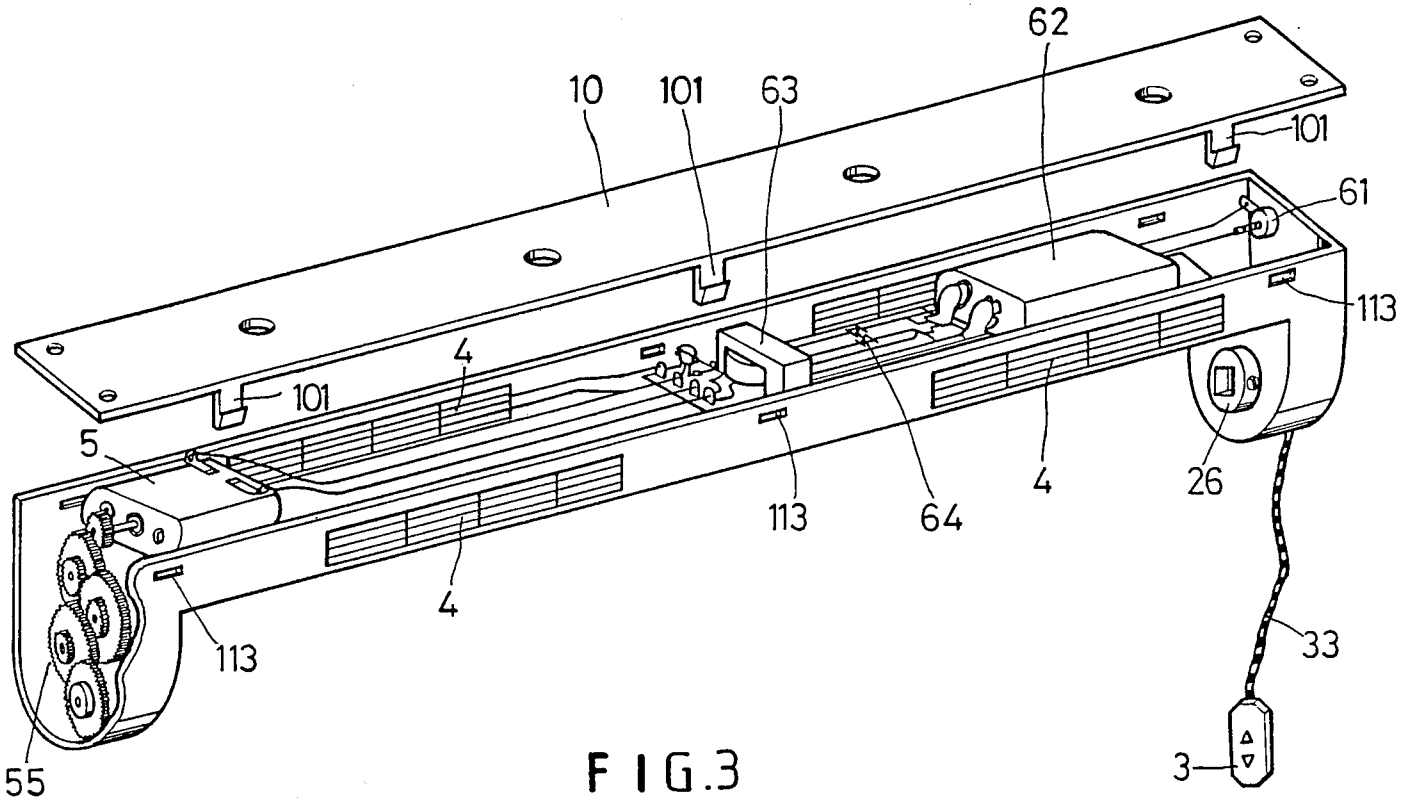
FIG. 3 is a perspective and exploded view of the window blind system wherein the roller blind mechanism is removed.

Referring to FIG. 3, the cover plate 10 is further provided with legs 101 extending downwardly and terminatong with hooks respectively which are adapted to be caught in slots 113 formed in a side wall of the casing 11 as the opening thereof is closed with the cover plate 10. A connector 61 for supplying AC home current, a rechargeable battery 62, a rectifier 64 for converting alternating current of home electric power into pulsating or direct current and transformer 63, a control circuit in association with solar electric power source 4 and the motor 5 are properly arranged in the longitudinal portion of the casing 11.

Figure 4:
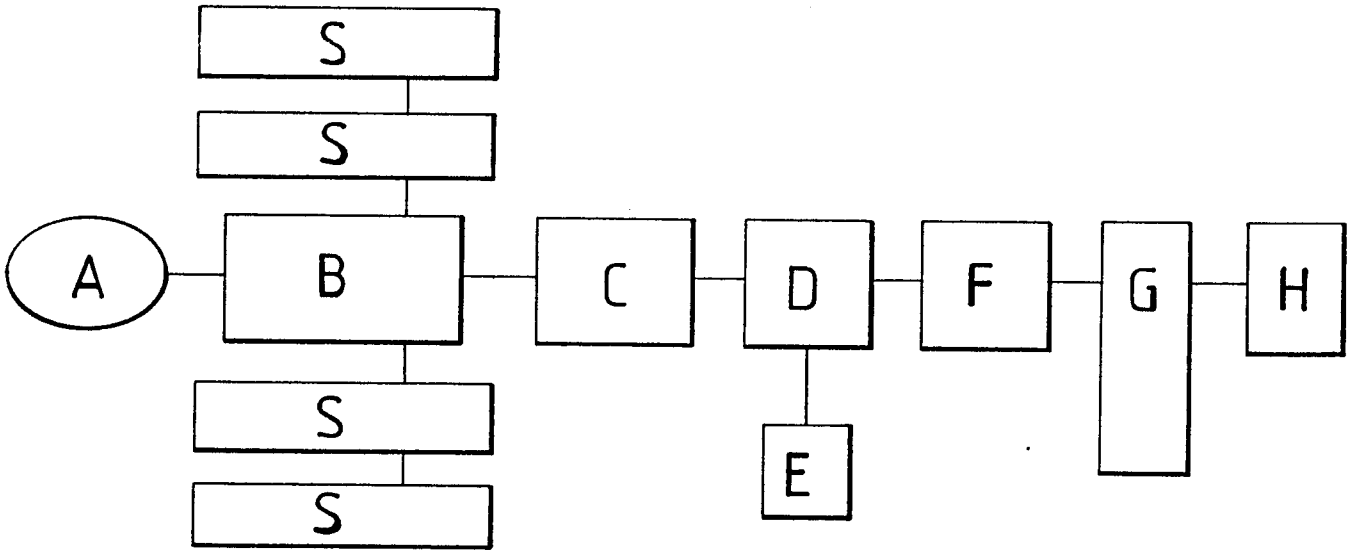
FIG. 4 is a schematic layout of the present invention.

Referring to FIG. 4, home electric power source designated at A and solar power sources designated at S are led into a transformer or rectifier designated at B for adaptation and further charging the battery designated at C. The battery C fuctions as a power source of a control circuit designated at D and remotely controlled by a controller designated at E. The motor designated at F is operated to drive the roller blind mechanism designated at H to roll out or rewind the blind through a redection gear assembly designated at G.

Figure 5:
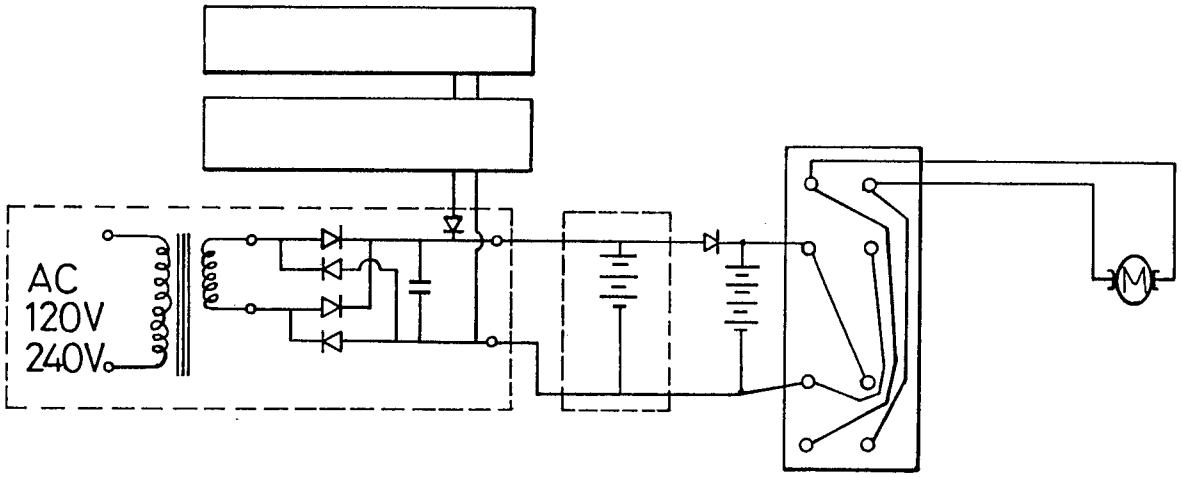
FIG. 5 is a control circuit used in this invention.

FIG. 5 illustrates a control circuit, for reference only, suitable for using in this invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A window blind system for shading a window assembly comprising:

a longitudinal casing having an open top portion defining a top chamber and a pair of opposed right-angled end portions extending downwardly defining a pair of side chambers in open communication with said top chamber;

a cover member adapted for closing the opening in the top portion of the casing;

means for securing the cover member to the casing;

a roller blind mechanism carrying a blind and having a roller fitted with two spaced circular discs for retaining a wound blind therebetween;

means for mounting said roller blind mechanism to the casing transversely between the right-angled end portions and under a longitudinal directed portion of the casing;

power sources combining (1) a solar power system having a plurality of solar mirrors mounted in a side wall of the casing and exposed to the sunlight, (2) a home electric power system and, (3) a rechargeable battery power system mounted in the casing;

driving means having a reversible power unit powered by the power sources combination and a driving unit engaged with the roller of the roller blind mechanism, said driving unit being mounted in one of said side chambers being coupled on opposing ends to said reversible power unit and said roller blind mechanism, said driving unit including a reduction gear mechanism for reducing the rotative speed of said power unit; and control means having a control circuit and control unit for operating the roller blind mechanism to roll out or rewind the blind.

* * * * *

UNITED STATES PATENT AND TRADEMARK OFFICE

CERTIFICATE OF CORRECTION

PATENT NO. : 4,951,730

DATED : August 28, 1990

INVENTOR(S) : Chih-Hsueh Hsu; Chad D.C. Hsieh; Janson Hong

It is certified that error appears in the above-identified patent and that said Letters Patent is hereby corrected as shown below:

On the title page, in item [76], after "Taiwan" insert the following:

--, Chad D.C. Hsieh, 4F, No. 144, Chu Lin Road, Yung Ho, Taipei, Taiwan, R.O.C. and Janson Hong, Room A, 2F, No. 360, Fu-Hsing South Road, Sec. 1, Taipei, Taiwan, R.O.C.--

Signed and Sealed this

Twenty-eighth Day of July, 1992

*Attest:*

DOUGLAS B. COMER

*Attesting Officer*

*Acting Commissioner of Patents and Trademarks*